US006643380B2

(12) United States Patent
Rodemer

(10) Patent No.: US 6,643,380 B2
(45) Date of Patent: Nov. 4, 2003

(54) SHIELDED MICROPHONE MODULE AND PREAMPLIFIER

(75) Inventor: Klaus Rodemer, Lautertal (DE)

(73) Assignee: paragon AG, Paderborn (DE)

( * ) Notice: Subject to any disclaimer, the term of this patent is extended or adjusted under 35 U.S.C. 154(b) by 351 days.

(21) Appl. No.: 09/773,166

(22) Filed: Jan. 31, 2001

(65) Prior Publication Data

US 2001/0012374 A1 Aug. 9, 2001

(30) Foreign Application Priority Data

Feb. 2, 2000 (DE) ..... 100 04 408

(51) Int. Cl.[7] ..... H04R 11/04
(52) U.S. Cl. ..... 381/369; 381/355
(58) Field of Search ..... 381/355, 369, 381/360, 170, 171, 172, 173, 174, 175, 176, 177, 178, 179, FOR 147, FOR 148; 361/751, 752, 753, 796, 799, 800, 814, 816, 818; 455/90, 117, 278, 296, 300, 347; 174/35 R, 51

(56) References Cited

U.S. PATENT DOCUMENTS 4,399,703 A * 8/1983 Matzuk ..... 73/621
5,740,261 A * 4/1998 Loeppert et al. ..... 381/355
6,392,900 B1 * 5/2002 Petty et al. ..... 361/816

FOREIGN PATENT DOCUMENTS

DE 43 10 793 A1 2/1993
DE 195 45 760 C1 7/1995

* cited by examiner

*Primary Examiner*—Curtis Kuntz
*Assistant Examiner*—Brian Ensey
(74) *Attorney, Agent, or Firm*—Iandiorio & Teska

(57) ABSTRACT

A microphone module, comprising a microphone capsule (2) with an amplifier printed circuit board (4) attached thereto, is provided with a shield arrangement in the form of a half-shell, which encompasses the amplifier component elements located on one side of the printed circuit board, and which is soldered to the continuous metal lamination coating located on the opposite side of said board. The resulting shield trough surrounds the half of the metallic microphone capsule, fitted into it, while making contact thereto. The half of the rear side of the microphone capsule projecting above the printed circuit board (4) is provided with a metallized shield (14), which is in contact with the capsule housing and with the lamination coating (12) of the printed circuit board (4). The amplifier circuit on the printed circuit board is therefore completely shielded and effectively protected against interference scatter. To achieve the desired directional effect, sound pressure apertures (22) are arranged on the rear side of the microphone capsule (2), and, in order to retain and improve their effectiveness, the amplifier printed circuit board (4) is provided with corresponding cut-outs (24) on its edge on the microphone side (FIG. 1).

5 Claims, 1 Drawing Sheet

SHIELDED MICROPHONE MODULE AND PREAMPLIFIER

FIELD OF THE INVENTION

The invention relates to a microphone module with the features described in the preamble to claim 1.

BACKGROUND OF THE INVENTION

A body vibration pickup microphone is known from DE 43 10 793 A1 for installation in a helmet (motorcycle, fire brigade, etc.), with which a flat basic body can be secured by means of an abrasive contact closure system to the inside of the helmet, and the microphone is arranged in a rubber bellows element located on the opposite side of the basic body, so that, when the helmet is put on, it is pressed against the head, and, on speaking, it picks up the surface-borne sound conducted to the surface of the skull. The flat basic body also contains a motherboard with the microphone amplifier.

Also known from DE 195 45 760 C1 is a digital audio device, in which the microphone amplifier is surrounded inside the audio device housing by its own shielding arrangement, in which provision is also made for an A/D converter, so that the complete analog input part of the audio device is screened against electromagnetic scatter interference.

For different application purposes, such as hands-free communications systems in car telephones, mobile radio systems, paging systems, etc., microphone modules are used in which the microphone capsule is assembled directly with a pre-amplifier, so that the weak microphone signals are impeded as little as possible by radiation scatter interference, which impair the understandability of the system. The pre-amplifier is formed on a printed circuit board, on which the microphone capsule is secured by means of a rubber retaining element, and to shield the amplifier a shielding cover is placed onto the circuit board on both sides, which both shields the components on the one side, as well as shielding the printed circuit paths on the other, against environmental interference.

SUMMARY OF THE INVENTION

The objective on which the invention is based is of improving such a microphone module in respect of its shielding capacity against interference scatter (immission of electromagnetic waves), with the possibility of retaining the directional characteristics of the microphone, and if possible of improving them.

This objective is achieved by the features described in claim 1. Further embodiments of the invention are characterised in the subclaims.

By the use of printed circuit board lamination coating as shield, instead of for forming the conductor paths, an individual shielding of the lamination coating side of the printed circuit board becomes superfluous, so that only the component fitting side, on which the connection conductors are provided for, needs to be shielded. The invention makes provision in this connection for a half-liner or trough, the walls of which are soldered all around with the circuit board lamination coating, so that a connection is obtained which is absolutely tight against interference scatter. The microphone capsule, half of which is metallised on its rear side, can readily be soldered to this trough or tub, in which situation its metal housing forms a continuous contact with the shield trough, which is intensified by pressure from outside when the module is inserted into a housing. The metallisation on the rear side of the microphone capsule can likewise be easily soldered in with the metal lamination coating of the printed circuit board, as a result of which on the one hand the microphone is secured to the printed circuit board, and, on the other, a good shield effect can also be achieved between the microphone capsule and the printed circuit board.

To achieve a specific directional effect, which is required with microphones of this nature, apertures are formed in the rear wall of the microphone capsule, by means of which the sound pressure on the rear side of the membrane can be influenced in the sense of the desired directional characteristics. If provision is made for corresponding cut-outs at the edge of the printed circuit board, at which the board is connected (soldered) to the microphone capsule, at the points at which the capsule apertures are located, then the directional effect of the microphone capsule will not be impaired, but can even be improved. In order to improve the desired directional effect, in an advantageous embodiment of the invention, the microphone capsule is secured obliquely to the printed circuit board, so that the longitudinal axis of the microphone capsule accordingly forms an angle with the surface of the printed circuit board. An angle of 22° has proved to be particularly favourable in this context.

BRIEF DESCRIPTION OF THE DRAWINGS

The invention is explained in greater detail hereinafter on the basis of the appended drawings, which show.

DETAILED DESCRIPTION OF THE INVENTION

Figure 1:
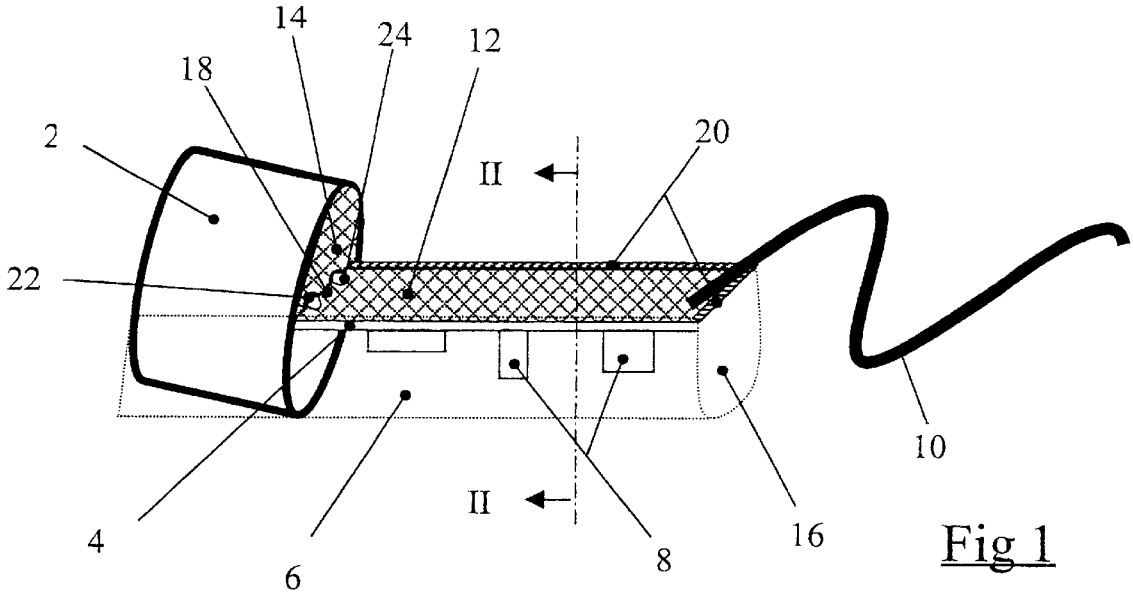
FIG. 1 a schematic perspective view of the microphone module according to the invention.
Figure 2:
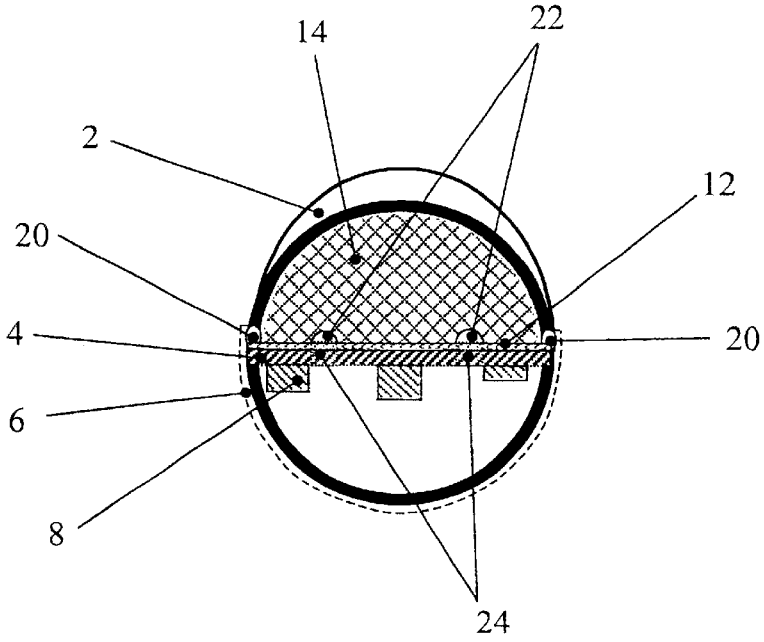
FIG. 2 a sectional view along the line II—II through the microphone module according to FIG. 1.

FIG. 1 shows a microphone capsule 2, which is located at the end of an amplifier printed circuit board 4. In addition, a shielding trough or tub 6, drawn in the figure as a phantom, can also be seen, which surrounds the lower side of the printed circuit board 4 with the components 8 and the lower half of the microphone capsule 2. A connection cable 10 leads from the printed circuit board to a downstream circuit, not shown here, in which the microphone signals are processed.

On the surface facing upwards in the figures, the printed circuit board 4 is provided with a continuous metal lamination coating 12, which in this case is not used, as usual, to form conductor paths, which in this case run on the component side located opposite. Rather, the lamination covering, which usually consists of copper, forms a closed surface, which shields the electrical circuit of the amplifier printed circuit board from above. The shielding downwards is provided by the shield tub 6, which encompasses the component element 8 and the conductors running between them.

The microphone capsule 2 is likewise metallised unilaterally on its rear, in the form of shield 14, which in the figures is represented by hatching, as is the copper lamination coating 12. The orientation of the microphone capsule 2 in relation to the printed circuit board 4 is effected in such a way that, on the lateral edge of the printed circuit board, on which the microphone capsule 2 is located, the lamination coatings 12 and shield 14 can be soldered to one another, whereby, on the one hand, the microphone capsule is secured to the printed circuit board and, on the other, the shielding is continued by the printed circuit board 4 lamination coating 12 in the shield 14. As the figures show, the microphone capsule 2 is located somewhat obliquely to the printed circuit board 4, which is connected to the directional characteristics of the microphone in a manner explained hereinafter.

The shielding tub or trough 6 is enclosed on the right side in FIG. 1 by an end plate 16, which for example can be soldered to the trough 6. On the opposite side, the microphone capsule 2 is fitted into the trough 6 in such a way that its rounding on the bottom matches precisely with the round cross-section of the trough, and a continuous contact of the metallic capsule housing is achieved with the sheet-metal trough, providing a contact. If the module represented is placed, after completed manufacture, into a housing consisting for example of plastic material, then it presses from the outside against the contact line between the shielding trough and the edge of the microphone capsule, with the result that in this case no soldering to the housing capsule is required, which would otherwise lead to damage to the microphone membrane, due also to the heating of the housing capsule incurred during soldering.

The soldered connection between the metal lamination coating 12 of the printed circuit board 4 and the shield 14 of the microphone capsule 2 is represented in FIG. 1 as the solder seam 18, while the solder connections of the edges of the printed circuit board with the shielding trough 6 are designated as solder seams 20. By means of these solder means seams, as well as the contact between the lower edge of the microphone capsule and the shielding trough 6, in conjunction with the shield 14 on the reverse side of the microphone and its metal capsule, to which in turn the shielding trough 6 is connected underneath, a shielding effect which is tight against interference scatter is achieved for the amplifier circuit on the printed circuit board, so that even weak microphone signals can be transferred free of interference to the downstream circuit.

On the reverse side of the microphone capsule are located two sound pressure apertures 22, which allow for a specific compensation of the sound pressure during the movements of the membrane, with the result that, for example, a kidney-shaped directional characteristic is derived. The invention makes provision for two cut-outs 24, for example semi-circular in shape, corresponding to these apertures 22, on the edge of the amplifier printed circuit board 4 which is soldered to the microphone capsule 2, by means of which a connection is established between the apertures 22 and the environment, so that the directional characteristics of the microphone are still retained, or even improved, when the amplifier printed circuit board 2 and the shielding trough 6 are placed in position. To achieve these directional characteristics, in addition, the microphone capsule 2 is set obliquely to the printed circuit board, whereby the mid-axis of the microphone capsule 2, in this special case, forms an angle of 22° with the plane of the printed circuit board 2.

What is claimed is:

1. A microphone module having a microphone capsule, a printed circuit board comprising a preamplifier, to which circuit board a lateral edge of the microphone capsule is attached, and a shield device for the circuit board, characterised in that the printed circuit board (4) contains components (8) and their connection conductors on one side only, while its other side is provided with a continuous metal lamination coating (12), and that the shield device, in the form of a trough or tub (6), closed on at least one side thereof, is formed by a shielding metal sheet, and is arranged above the component fitting side of the printed circuit board (4) in such a way that the opposite side of the trough is closed off by the microphone capsule (2), and that the shielding trough (6) is soldered at its edge to the lamination coating (12) of the printed circuit board in a manner which is tight against interference scatter (soldered seams 18, 20).

2. A microphone module according to claim 1, characterised in that the trough (6) has a cambered cross-section matched to the shape of the microphone capsule (2), with the microphone capsule being fitted into one end of the trough, providing contact with its metal capsule, and in that the trough is closed off at its other end by an end plate (16) having a corresponding edge cambering.

3. A microphone module according to claim 2, characterised in that the round microphone capsule (2) is covered on half of its reverse side by a metallic shield (14), and is located against one edge of the printed circuit board (4), along which the metal laminations (12, 14) of the printed circuit board and the microphone capsule are soldered to one another.

4. A microphone module according to one of the preceding claims, characterised in that the microphone capsule (2) is arranged obliquely to the printed circuit board (4), with its centre axis inclined against the plane of said circuit board.

5. A microphone module according to claim 1 characterized in that the microphone capsule (2) is provided on its rear side with sound pressure apertures (22), which determine the directional effect, and cut-outs (24) corresponding to said sound pressure apertures (22) being formed at the connection edge of the printed circuit board (4) with the microphone capsule (2).

* * * * *